US011600247B2

(12) United States Patent
Lesko

(10) Patent No.: US 11,600,247 B2
(45) Date of Patent: Mar. 7, 2023

(54) MUSICAL INSTRUMENT STRING FERRULE TUBES

(71) Applicant: Robert J. Lesko, Morton Grove, IL (US)

(72) Inventor: Robert J. Lesko, Morton Grove, IL (US)

( * ) Notice: Subject to any disclaimer, the term of this patent is extended or adjusted under 35 U.S.C. 154(b) by 163 days.

(21) Appl. No.: 17/083,003

(22) Filed: Oct. 28, 2020

(65) Prior Publication Data

US 2021/0151011 A1 May 20, 2021

Related U.S. Application Data

(60) Provisional application No. 62/936,799, filed on Nov. 18, 2019.

(51) Int. Cl.

| | |
|---|---|
| ***G10D 3/12*** | (2020.01) |
| ***G10D 3/04*** | (2020.01) |
| ***G10D 3/14*** | (2020.01) |
| ***G10D 1/08*** | (2006.01) |
| ***G10D 3/06*** | (2020.01) |

(52) U.S. Cl.

CPC ..... *G10D 3/12* (2013.01); *G10D 1/085* (2013.01); *G10D 3/04* (2013.01); *G10D 3/06* (2013.01); *G10D 3/14* (2013.01)

(58) Field of Classification Search

CPC ..... G10D 3/12; G10D 1/085; G10D 3/04; G10D 3/06; G10D 3/14; G10D 1/08

See application file for complete search history.

(56) References Cited

U.S. PATENT DOCUMENTS

| | | | | |
|---|---|---|---|---|
| 9,892,717 | B2 * | 2/2018 | Finkle | G10D 1/08 |
| 2006/0070508 | A1 * | 4/2006 | Butler | G10D 3/12 84/297 R |

* cited by examiner

*Primary Examiner* — Kimberly R Lockett

(74) *Attorney, Agent, or Firm* — Lewis Roca Rothgerber Christie LLP

(57) ABSTRACT

The retainer for securing a musical instrument string to a body of a musical instrument includes a first casing portion defining a first opening and a ball-end chamber therein. The first opening is located at a proximal end of the retainer and a second casing portion is located at a distal end of the first casing portion. The second casing portion defines a passageway from the ball-end chamber to a second opening located at a distal end of the retainer. The passageway length is greater than the ball-end chamber length, and the ball-end chamber width is greater the passageway width.

20 Claims, 4 Drawing Sheets

MUSICAL INSTRUMENT STRING FERRULE TUBES

CROSS-REFERENCE TO RELATED APPLICATION(S)

This application claims priority to, and the benefit of, U.S. Provisional Application 62/936,799, filed on Nov. 18, 2019 in the U.S. Patent and Trademark Office, the entire content of which is incorporated herein by reference.

FIELD

One or more aspects of embodiments according to the present invention generally relate to an improved musical instrument string retainer, a musical instrument including the string retainer, and a method of using the string retainer in a stringed musical instrument.

BACKGROUND

Stringed musical instruments (e.g., electric guitars, electric basses, and others) commonly have string holes formed (e.g., drilled) through the body of the musical instrument (e.g., from a top/playing surface to a bottom/back surface) to help with securing one end of a musical instrument string to the musical instrument. Musical instrument strings commonly have two ends—a "ball end" that is typically secured to the body of the instrument and an opposite end (e.g., the other end or non-ball end) that is typically secured to a tuning post on a head of the musical instrument. The ball end is designed to be thicker than the opposite end of the string.

To secure a string to a musical instrument, the string is typically inserted, non-ball end first, through a ferrule (e.g., a retainer) in the bottom surface of the body and fed through the string hole (e.g., a drill hole) in the body until the string emerges from the top surface of the body (e.g., through a hole in a bridge). The ferrule is structured such that the non-ball end of the string may pass, while the ball end of the string may not pass. Thus, the non-ball end of the string may be secured to a tuning post, while the ball end of the string is secured to the body of the musical instrument, and a tension may be applied to the string.

However, when a string is inserted through a conventional ferrule it may get stuck on the side of the drill hole (e.g., the string hole in the body) and/or hit the bottom of the bridge. What is needed is a string retainer that may replace conventional string ferrules and prevent re-stringing problems by extending the ferrule through the musical instrument body (e.g., all the way through the body and flush against the bridge). Thus, the string may pass directly through the musical instrument without getting stuck on the raw wood or under the bridge. Additionally, the added mass of the string retainer, extending through the body of the musical instrument, may increase the sustain provided to musical notes while the musical instrument is played.

SUMMARY

Aspects of embodiments of the present disclosure are directed toward an improved musical instrument string retainer, a musical instrument including the string retainer, and a method of using the string retainer in a stringed musical instrument.

One embodiment of the present invention provides a retainer for securing a musical instrument string to a body of a musical instrument, the retainer including a first casing portion defining a first opening and a ball-end chamber therein. The first opening is located at a proximal end of the retainer, and a second casing portion is located at a distal end of the first casing portion, and defines a passageway from the ball-end chamber to a second opening located at a distal end of the retainer. A passageway length is greater than a ball-end chamber length, and a ball-end chamber width is greater than a passageway width.

The retainer may have a first casing portion width being greater than a second casing portion width.

The retainer may have the first casing portion and the second casing portion being integrally formed.

The retainer may have an overall length being between about 1.8 inches and about 2.0 inches.

The retainer may include an alloy.

The retainer may include a flange located at a proximal end of the retainer, a flange width being greater than a first casing portion width.

The retainer may be for a guitar or a bass.

The retainer may have the passageway width being about equal to or less than a diameter of a bridge string hole.

The retainer may have the ball-end chamber width being about equal to or greater than a first width and a second width of a ball end of the musical instrument string.

The retainer may have the ball-end chamber length being about equal to or greater than a ball-end height of the musical instrument string.

The retainer may have the passageway width being about equal to or greater than a thickness of the musical instrument string and less than a first width and a second width of a ball end of the musical instrument string.

The retainer may have a depth being about equal to a body depth of the musical instrument.

The retainer may have a first casing portion width being about equal to a bottom portion width of a body string hole.

The retainer may have a second casing portion width being about equal to or greater than a top portion width of a body string hole.

Another embodiment of the present invention provides a stringed musical instrument including: a head including a tuning post, a neck, a body including a body string hole, a bridge including a bridge string hole, and a retainer. The retainer includes: a first casing portion defining a first opening and a ball-end chamber therein, the first opening being located at a proximal end of the retainer, and a second casing portion located at a distal end of the first casing portion and defining a passageway from the ball-end chamber to a second opening located at a distal end of the retainer. A passageway length is greater than a ball-end chamber length, and a ball-end chamber width is greater than a passageway width.

The stringed musical instrument may have the passageway width being about equal to or less than a diameter of the bridge string hole.

The stringed musical instrument may have a retainer depth being about equal to a body depth of the stringed musical instrument.

The stringed musical instrument may have a width of the second casing portion being about equal to or greater than a top portion width of a body string hole.

The stringed musical instrument may be a guitar or a bass.

Another embodiment of the present invention provides a method for securing a musical instrument string to a musical instrument. The method includes: securing a non-ball end of the musical instrument string to a tuning post; and securing a ball end of the musical instrument string to a retainer in a body of the musical instrument. The retainer includes: a first casing portion defining a first opening and a ball-end chamber therein, the first opening being located at a proximal end of the retainer, and a second casing portion located at a distal end of the first casing portion and defining a passageway from the ball-end chamber to a second opening located at a distal end of the retainer. A passageway length is greater than a ball-end chamber length, and a ball-end chamber width is greater than a passageway width.

BRIEF DESCRIPTION OF THE DRAWINGS

The above and other features and aspects of the present disclosure will become more apparent by describing, in detail, example embodiments thereof with reference to the specification, claims, and appended drawings wherein:

DETAILED DESCRIPTION

Figure 1:
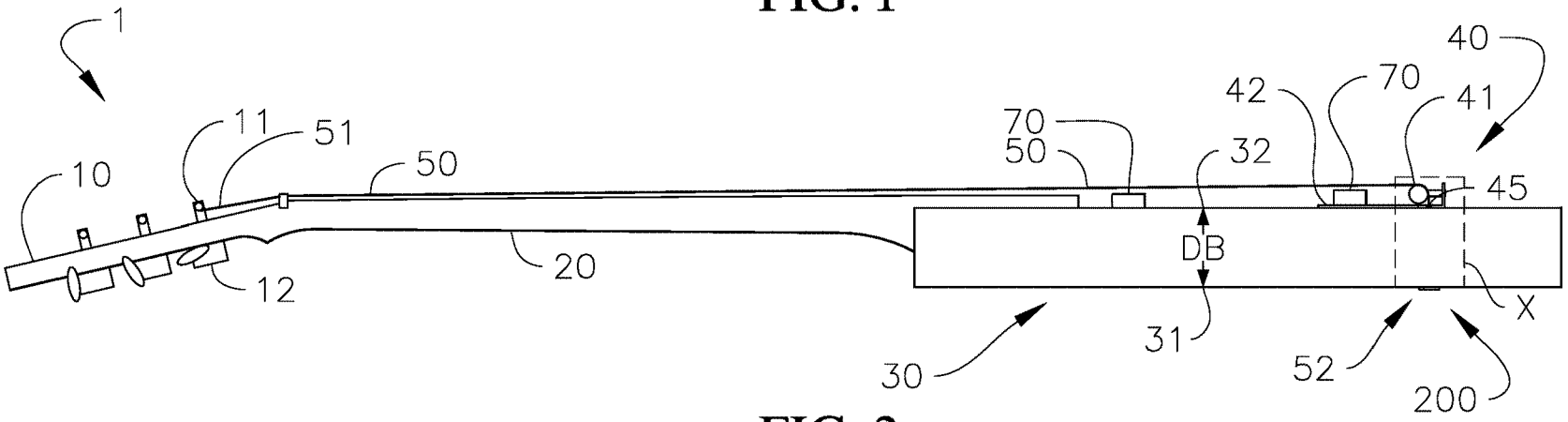
FIG. 1 is a side view of a stringed musical instrument including a string retainer according to an embodiment of the present disclosure.

Features of the present disclosure and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those of ordinary skill in the art. Accordingly, processes, elements, and techniques that are not necessary to those having ordinary skill in the art for a complete understanding of the aspects and features of the present inventive concept may not be described.

Unless otherwise noted, like reference numerals denote like elements throughout the attached drawings and the written description, and thus, descriptions thereof will not be repeated. Furthermore, parts not related to the description of the embodiments might not be shown to make the description clear. In the drawings, the relative sizes of elements, layers, and regions may be exaggerated for clarity.

It will be understood that when an element is referred to as being "on," "connected to," or "coupled to" another element, it may be directly on, connected, or coupled to the other element or one or more intervening elements may also be present. When an element is referred to as being "directly on," "directly connected to," or "directly coupled to" another element, there are no intervening elements present. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, the term "substantially," "about," "approximately," and similar terms are used as terms of approximation and not as terms of degree, and are intended to account for the inherent deviations in measured or calculated values that would be recognized by those of ordinary skill in the art. "About" or "approximately," as used herein, is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value. Further, the use of "may" when describing embodiments of the present disclosure refers to "one or more embodiments of the present disclosure."

As used herein, the term "and/or" includes any and all combinations of one or more of the associated listed items. Furthermore, the use of "may" when describing embodiments of the present invention relates to "one or more embodiments of the present invention."

When a certain embodiment may be implemented differently, a specific process order may be performed differently from the described order. For example, two consecutively described processes may be performed substantially at the same time or performed in an order opposite to the described order.

Also, any numerical range disclosed and/or recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such subranges would comply with the requirements of 35 U.S.C. § 112(a) and 35 U.S.C. § 132(a).

Specific structural or functional descriptions disclosed herein are merely illustrative for the purpose of describing embodiments according to the concept of the present disclosure. Thus, embodiments disclosed herein should not be construed as limited to the particular illustrated shapes of regions, but are to include deviations in shapes that result from, for instance, manufacturing.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

Spatially relative terms, such as "beneath," "below," "lower," "above," "upper," "bottom," "top" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" or "over" the other elements or features. Thus, the term "below" may encompass both an orientation of above and below. The device may be otherwise oriented (rotated 90 degrees or at other orientations), and the spatially relative descriptors used herein should be interpreted accordingly.

Referring to FIG. 1, a side view of a musical instrument 1 (e.g., a stringed musical instrument, such as a guitar, bass, or other stringed musical instrument) including a retainer 200 (e.g., a string retainer or a string ferrule tube) is shown. The musical instrument 1 may include a head 10, a neck 20, and a body 30. The head 10 may include a tuning post 11 (e.g., a peg) and/or a tuner 12 (e.g., a tuning machine). The neck 20 may connect the head 10 to the body 30. The body 30 may include a top side 32 (e.g., a playing surface or front surface) and a bottom side 31 (e.g., a back surface) opposite to (e.g., below) the top side 32. The distance between the top side 32 and the bottom side 31 may define a body depth DB of the body 30. Various components may be mounted to (e.g., above) the top side 32. For example, a transducer 70 (e.g., a pickup) and a bridge 40 may be mounted to (e.g., secured to) the body. The bridge 40 may include a saddle 41 and a bottom plate 42 having a bridge string hole 45 therethrough. The saddle 41 may be a structure upon which a string 50 (e.g., a musical instrument string) may be seated above the top side 32.

The retainer 200 may be mounted to (e.g., within) the body 30 and may be, at least, partially accessible (e.g., more accessible) from the bottom side 31. The retainer 200 may be located substantially within an area (e.g., a region) of the body 30 labeled with an "X" in FIG. 1—e.g., an area between the top side 32 and the bottom side 31 and in proximity to the bridge string hole 45. The string 50 may be secured at a ball end 52 to the retainer 200 and may exit the body 30 through the bridge string hole 45. The string 50 may be secured at a non-ball end 51 (e.g., an opposite end or other end of the string 50 from the ball end 52) to the tuning post 11. The string 50, being secured at both ends, may be tuned (e.g., loosened or tightened) by adjusting the tuner 12.

Figure 2:
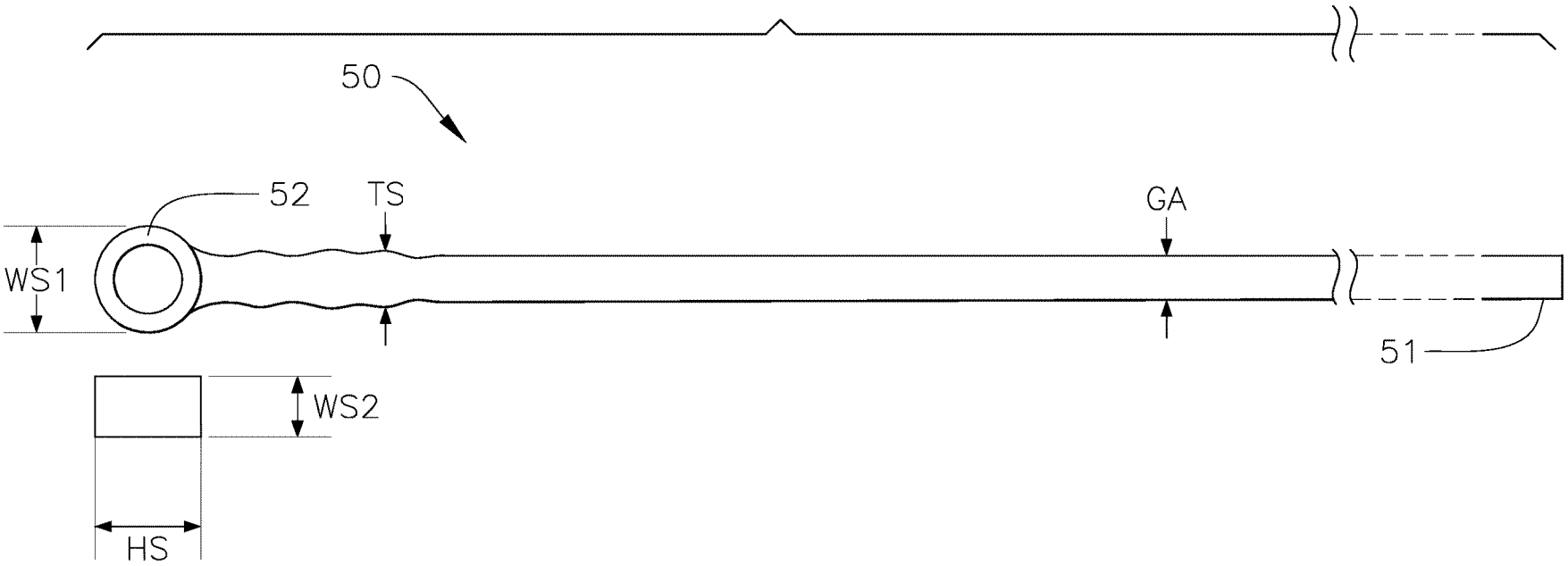
FIG. 2 is a perspective view of a common musical instrument string.

Referring to FIG. 2, a perspective view of a common configuration of the string 50 is shown. The common features of the string 50 are identified to help in describing aspects of embodiments of the present disclosure. Specifically, the string 50 may include two ends—the ball end 52 and the non-ball end 51. The ball end 52 may have a substantially rounded (e.g., a substantially cylindrical) shape or some other bulky shape making it thicker than a thickness TS of the string 50. For example, the ball end 52 may have a first width WS1 and a second width WS2. The first width WS1 may be equal to or different than the second width WS2 and may be positioned substantially parallel to the thickness TS of the string 50. The thickness TS of the string 50 may correspond to a gauge GA (e.g., a diameter or a playing region diameter) of the string 50 and may be slightly larger. The ball end 52 may have a ball-end height HS, which may be positioned substantially perpendicular to the thickness TS of the string 50.

Furthermore, musical instrument strings in general are provided in standard gauges with common ball end sizes, such that those of ordinary skill in the art would readily be able to determine the dimensions of the strings for a given stringed musical instrument. For example, a "46 gauge" electric guitar string may have: the gauge GA being equal to about 0.046 inches; the thickness TS near the ball end 52 being equal to about 0.07 inches; the first width WS1 of the ball end 52 being equal to about 0.16 inches; the second width WS2 of the ball end 52 being equal to about 0.12 inches; and the ball-end height HS being equal to about 0.16 inches.

Figure 3:
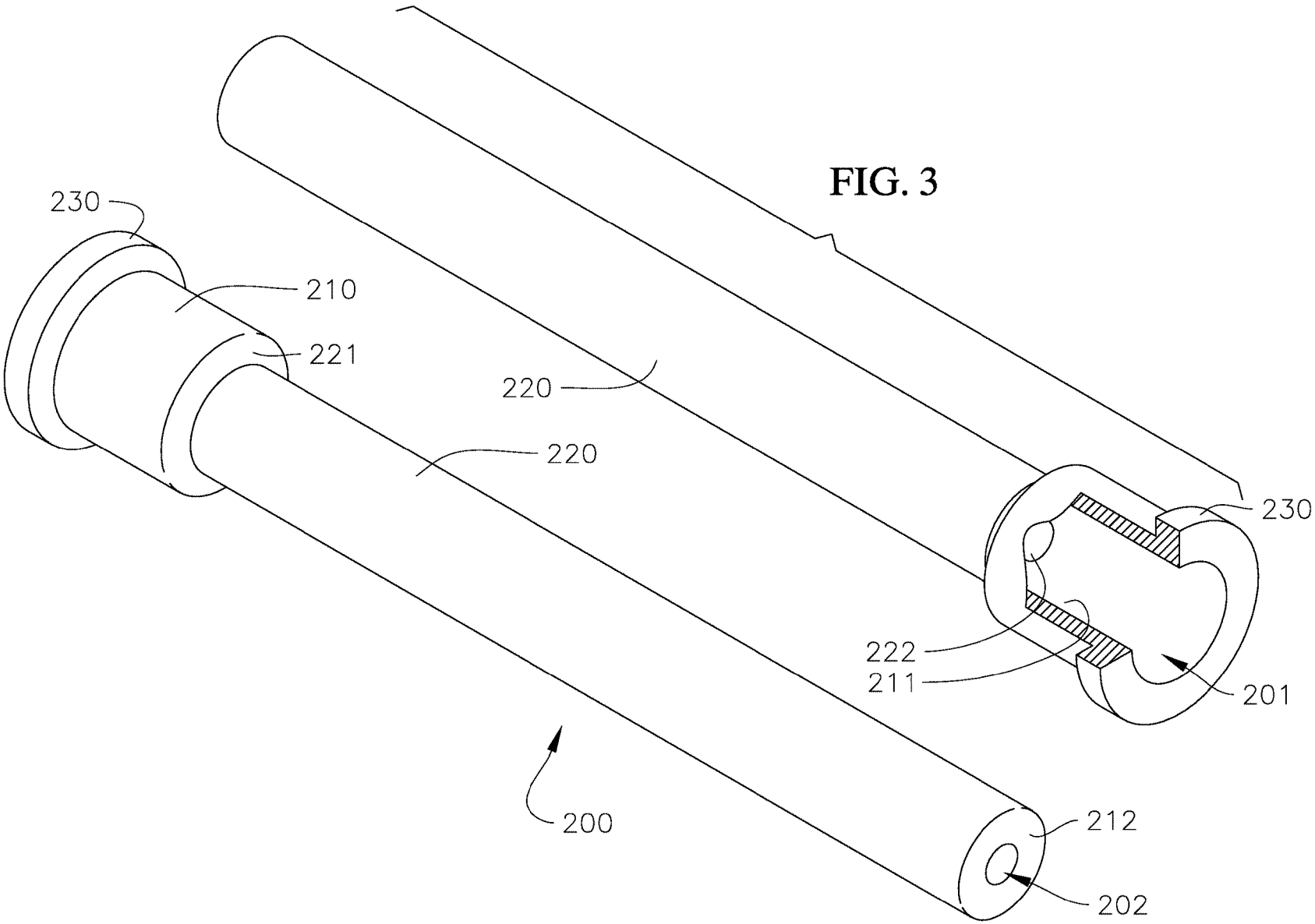
FIG. 3 is a perspective view of the string retainer.

Referring to FIG. 3, a perspective view of the retainer 200 is shown. While some embodiments of the retainer 200 may have a substantially tubular (e.g., rounded or cylindrical) shape, the present disclosure is not limited thereto. For example, the retainer 200 according to the present disclosure may have a substantially elongated polygonal shape (e.g., having a plurality of substantially flat surfaces). Accordingly, some of the disclosed dimensions are provided in terms of width instead of diameter to encompass embodiments that may be substantially rounded and embodiments that may not be rounded.

The retainer 200 may include a first casing portion 210 and a second casing portion 220. The first casing portion 210 may include a flange 230 at a proximal end of the first casing portion 210 (e.g., a proximal end of the retainer 200) and a shoulder 221 at a distal end of the first casing portion. The first casing portion 210 may define a first opening 201 at the proximal end of the first casing portion and a ball-end chamber 211 (e.g., a seating region for the ball end 52 of the string 50) within the first casing portion 210.

While embodiments including the flange 230 are shown, the present disclosure is not limited thereto. For example, the retainer 200 may not have a flange (e.g., may have a flush-fit design). When a flush fit is used, the flange may be tapped into (e.g., fastened to or secured to) the bottom side 31 of the body 30, or the first casing portion 210 may simply not have the flange 230 in order to sit substantially flush (e.g., even) with the bottom side 31 of the body 30.

The second casing portion 220 may extend from a distal end of the first casing portion 210 (e.g., near the shoulder 221 of the first casing portion 210) to a distal end of the retainer 200 (e.g., at a tip end 212 of the retainer). The second casing portion 220 may define a passageway 222 (e.g., a passage through which the string 50 may pass)

extending from the ball-end chamber 211 to a second opening 202 at a distal end of the retainer 200.

Figure 4:
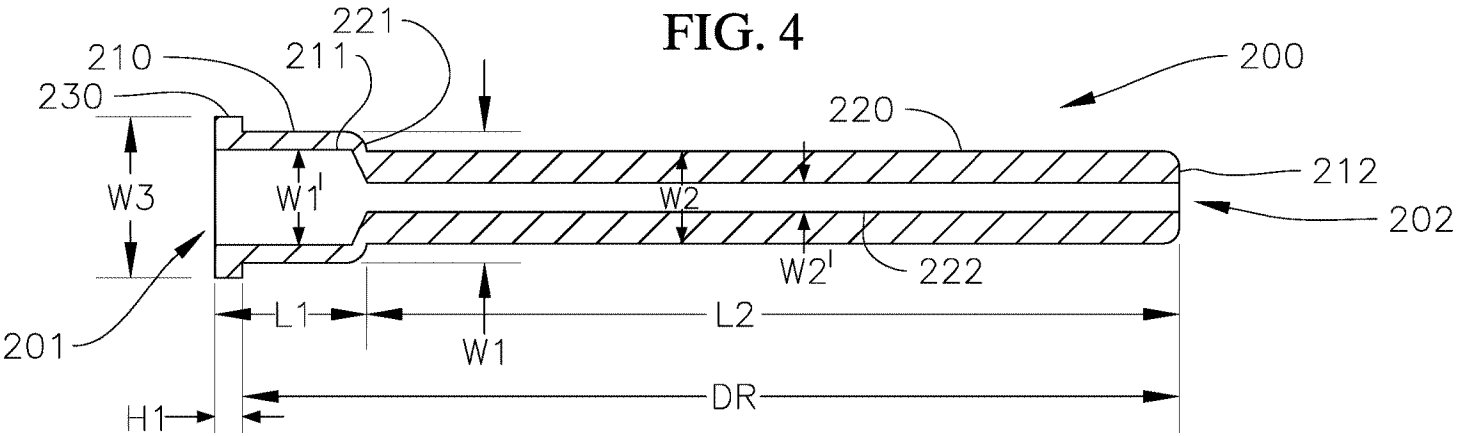
FIG. 4 is a lengthwise cross-sectional view of the string retainer.

Referring to FIG. 4, a lengthwise cross-sectional view of the retainer 200 is shown to illustrate several dimensional features of the retainer 200. The first casing portion 210 may have a first casing portion width W1 (e.g., an outer diameter that does not include the outer dimensions of the flange 230). The second casing portion 220 may have a second casing portion width W2 (e.g., an outer diameter of the extended/tubular portion of the retainer 200). While the retainer 200 is shown having the first casing portion width W1 being greater than the second casing portion width W2, the present disclosure is not limited thereto. For example, the first casing portion width W1 may be equal to the second casing portion width W2 in some embodiments. Furthermore, the flange 230 may have a flange width W3 (e.g., a diameter extending beyond the first casing portion width W1).

The ball-end chamber may have a chamber width W1' (e.g., an internal diameter within the first casing portion 210), which may be substantially the same size as, or slightly smaller, than the size of the first opening 201 (e.g., the ball-end chamber may have a slightly tapered profile). To fit the ball end 52 of the string 50, the chamber width W1' may be about equal to or greater than (e.g., slightly greater than) the larger of the first width WS1 and the second width WS2 of the ball end 52 of the string 50. The passageway 222 may have a passageway width W2' (e.g., an internal diameter within the second casing portion 220), which may be substantially the same size as the second opening 202. To allow the string 50 to pass through from the ball-end chamber 211 to the second opening 202 while preventing the ball-end 52 from passing, the passageway width W2' may be less than the chamber width W1' and greater than (e.g., slightly greater than) the thickness TS of the string 50 (shown in FIG. 2).

The ball-end chamber 211 may have a chamber length L1 corresponding to the ball-end height HS of the ball end 52 of the string 50 (shown in FIG. 2). For example, to keep the ball end 52 from protruding through the bottom side 31 of the body 30 (see FIG. 1), the chamber length L1 may be about equal to or greater than the ball-end height HS of the ball end 52. Furthermore, the passageway 222 may have a passageway length L2 corresponding substantially to the length of the second casing portion 220. The flange 230 may have a flange height H1, which, in some embodiments, may protrude beyond the bottom side 31 of the body 30 (as shown in FIG. 1).

Furthermore, a sum of the chamber length L1 and the passageway length L2 may correspond substantially to an overall length of the retainer 200 (e.g., an overall outer or inner length of the retainer). For example, in some embodiments, the overall length (e.g., L1+L2) of the retainer 200 designed for a common electric guitar or a common electric bass may be between about 1.8 inches and 2.0 inches.

Moreover, some embodiments of the retainer 200 designed for bass may be heavier duty (e.g., designed to handle more demanding use) than other embodiments of the retainer 200 made for guitar.

In some embodiments, the flange 230 may protrude beyond the bottom side 31 of the body. In such embodiments, a retainer depth DR may be defined as a sum of the chamber length L1 and the passageway length L2 minus the flange height H1.

Referring to FIGS. 1-6, to preserve the integrity of the body 30, by minimizing the removal of material from the body 30, the ball end 52 of the string 50 may be seated close to the bottom side 31 of the body 30. Furthermore, to allow the string 50 to pass directly through the body 30 without getting stuck on the raw wood of the body 30 or under the bridge 40, the retainer 200 may extend to at least three fourths of the way through the body 30 from the bottom side 31 to the top side 32 (e.g., the retainer depth DR may be about equal to the body depth DB or at least equal to about three fourths of the body depth DB). Accordingly, the passageway length L2 may be greater than the chamber length L1.

Referring to FIG. 4, to provide a dimensional example, some embodiments of the present disclosure designed for an electric guitar may have: the flange width W3 being equal to about 0.37 inches; the flange height H1 being equal to about 0.06 inches; the first casing portion width W1 being equal to about 0.25 inches; the second casing portion width W2 being equal to about 0.17 inches; a ball-end chamber length L1 being equal to about 0.32 inches; a passageway length L2 being equal to about 1.50 inches; the chamber width W1' being equal to about 0.19 inches; and the passageway width W2' being equal to about 0.08 inches.

To provide another example, some embodiments of the present disclosure designed for an electric bass may have: the flange width W3 being equal to about 0.37 inches; the flange height H1 being equal to about 0.06 inches; the first casing portion width W1 being equal to about 0.29 inches; the second casing portion width W2 being equal to about 0.23 inches; a ball-end chamber length L1 being equal to about 0.38 inches; a passageway length L2 being equal to about 1.63 inches; the chamber width W1' being equal to about 0.20 inches; and the passageway width W2' being equal to about 0.13 inches.

Figure 5:
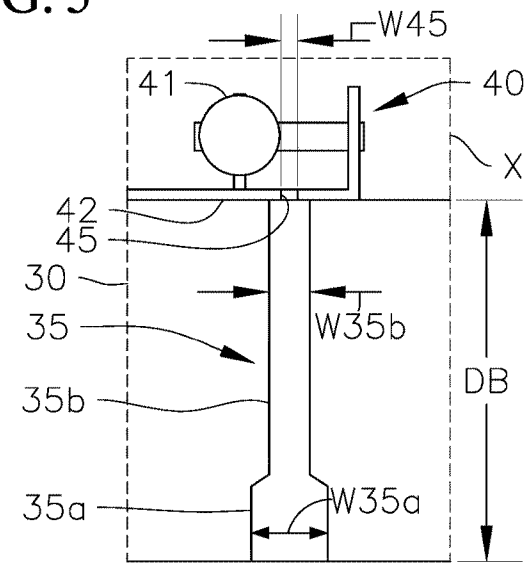
FIG. 5 is a cross-sectional side view of an area of the stringed musical instrument labeled with an "X" in FIG. 1 illustrating typical dimensions of a musical instrument body string hole with the string retainer not present.

Referring to FIG. 5, a cross-sectional side view of an area (e.g., a region) of the stringed musical instrument labeled with an "X" in FIG. 1 is shown to illustrate typical dimensions of a musical instrument body string hole. The body 30 may include a body string hole 35. The body string hole 35 may include a bottom portion 35*a* and a top portion 35*b*. Furthermore, the bottom portion 35*a* may have a bottom portion width W35*a* and the top portion 35*b* may have a top portion width W35*b*. The body string hole 35 may extend through an entirety of the body depth DB. The body string hole 35 may be positioned below the bridge 40. Specifically, the body string hole 35 may be positioned below the bridge string hole 45, having a bridge-string-hole diameter W45, in the bottom plate 42 of the bridge 40.

Furthermore, body string holes and bridge string holes are generally provided according to common dimensions, such that those of ordinary skill in the art would readily be able to determine the dimensions of the body string hole 35 and the bridge string hole 45 for a given stringed musical instrument. For example, the body string hole 35 for a common electric guitar designed for conventional string ferrules (e.g., ferrules having a structure that does not extend into the top portion 35*b* of the body string hole 35) may have the bottom portion width W35*a* being equal to about 0.25 inches and the top portion width W35*b* ranging from about 0.04 inches to about 0.11 inches depending on the manufacturer of the guitar. For further example, the bridge string hole 45 of a common electric guitar may have the bridge-string-hole diameter W45 being equal to about 0.13 inches.

Moreover, those of ordinary skill in the art would readily be able to determine distances between neighboring components (e.g., strings) and, thus, would recognize the extreme outer dimensional limits of the various widths—e.g., the flange width W3 may be limited by its proximity to neighboring components.

Figure 6:
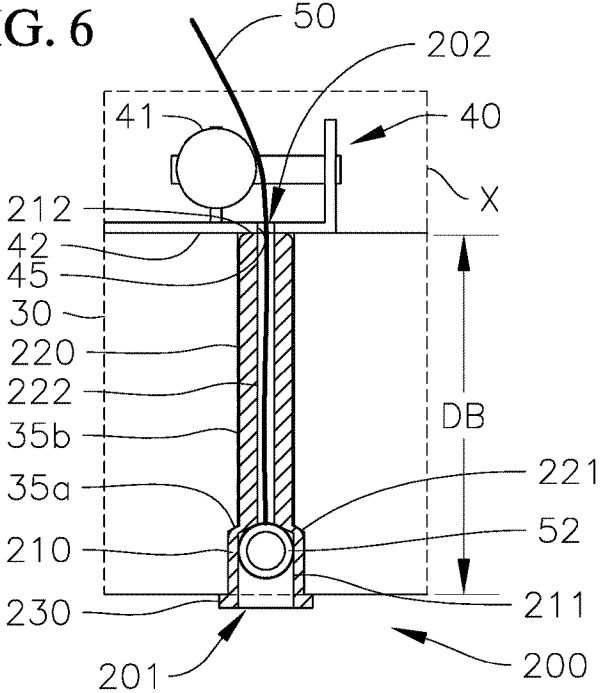
FIG. 6 is a cross-sectional side view of the area of the stringed musical instrument labeled with an "X" in FIG. 1 illustrating the placement of the string retainer within the body of the stringed musical instrument.

Referring to FIGS. 4-6, a cross-sectional side view of the area labeled "X" in FIG. 1 illustrating the placement of the string retainer within the body of a stringed musical instrument is shown. The first casing portion 210 may fit within the bottom portion 35*a* of the body string hole 35. Thus, the first casing portion width W1 of the first casing portion 210 may be about equal to the bottom portion width W35*a* of the bottom portion 35*a* of the body string hole 35. The second casing portion 220 may fit within the top portion 35*b* of the body string hole 35. Thus, the second casing portion width W2 of the second casing portion 220 may be about equal to the top portion width W35*b* of the top portion 35*b* of the body string hole 35. (To install the retainer 200 of the present disclosure into a musical instrument designed with conventional string ferrules, it may be necessary to increase the top portion width W35*b* by removing material from inside the body 30.) Furthermore, the relative dimensions of the body string hole 35 and the retainer 200 are such that the retainer 200 may be secured within the body 30 by way of a friction fit and, thus, may not easily fall out of the body 30. Accordingly, the void (e.g., empty space) of the body string hole 35 may be substantially filled by the first casing portion 210 and the second casing portion 220 of the retainer 200.

The passageway 222 and the second opening 202 may be aligned with the bridge string hole 45, and the passageway width W2' may be about equal to or less than the bridge-string-hole diameter W45. Furthermore, the tip end 212 of the retainer 200 may sit flush (e.g., about even or touching) with the bottom plate 42 of the bridge 40.

In some embodiments, the material of the retainer 200 may comprise an alloy (e.g., aluminum, brass, nickel, or zinc) to increase the sustain provided to musical notes when the musical instrument 1 is played. The best materials for providing such sustain are debatable (e.g., subjective). Furthermore, different materials may provide different sound characteristics (e.g., tone). For example, aluminum may provide a darker (e.g., less treble) tone, brass may provide a slightly brighter (e.g., more treble) sound with longer sustain, and zinc and nickel may be more neutral (e.g., closest to the original tone of the musical instrument).

Additionally, more completely filling the void of the body string hole 35 with the mass of the retainer 200 having an alloy material may increase sustain in comparison to using other materials (e.g., a composite or rubber may have a deadening effect). Furthermore, filling the void of the body string hole 35 with the mass of the retainer 200 having an alloy material may increase sustain in comparison to the original material (e.g., wood) of the body 30. For example, wood has voids (e.g., due to its grain) and is softer than alloy materials. Thus, wood may more readily absorb vibrations and provide a less rigid contact with the bottom of the bridge 40 than the retainer 200 having an alloy material.

In some embodiments, at least a portion (e.g., a visible portion) of the retainer 200 may be plated with an alloy or chromed to match different colors.

Referring to FIG. 4, a method of manufacturing the retainer 200 according to the present disclosure will be described. In some embodiments, the retainer 200 may be integrally formed (e.g., milled from one solid piece) by, for example, using a fully programmable CNS lathe or a manual lathe. First, material may be removed from the flange 230. Second, material may be removed from the first casing portion 210. Third, material may be removed from the second casing portion 220. Fourth, the passageway 222 may be drilled. Fifth, the ball-end chamber 211 may be drilled.

Referring to FIG. 5 and FIG. 6, the retainer 200 may be installed by drilling the body string hole 35 during manufacturing. As discussed briefly above, when replacing conventional string ferrules in an existing musical instrument (e.g., a string-through-body musical instrument), the conventional string ferrules may be removed, and the top portion 35*b* may be drilled to have the top portion width W35*b* being larger (e.g., slightly larger). The bottom portion 35*a* of the body string hole 35 may remain the same. Thus, installing the retainer 200 may show little sign of modification to the instrument.

Furthermore, the overall length of the retainer 200 may be filed down or the body 30 may be countersunk for an exact fit between the retainer 200 and the body 30.

Figure 7:
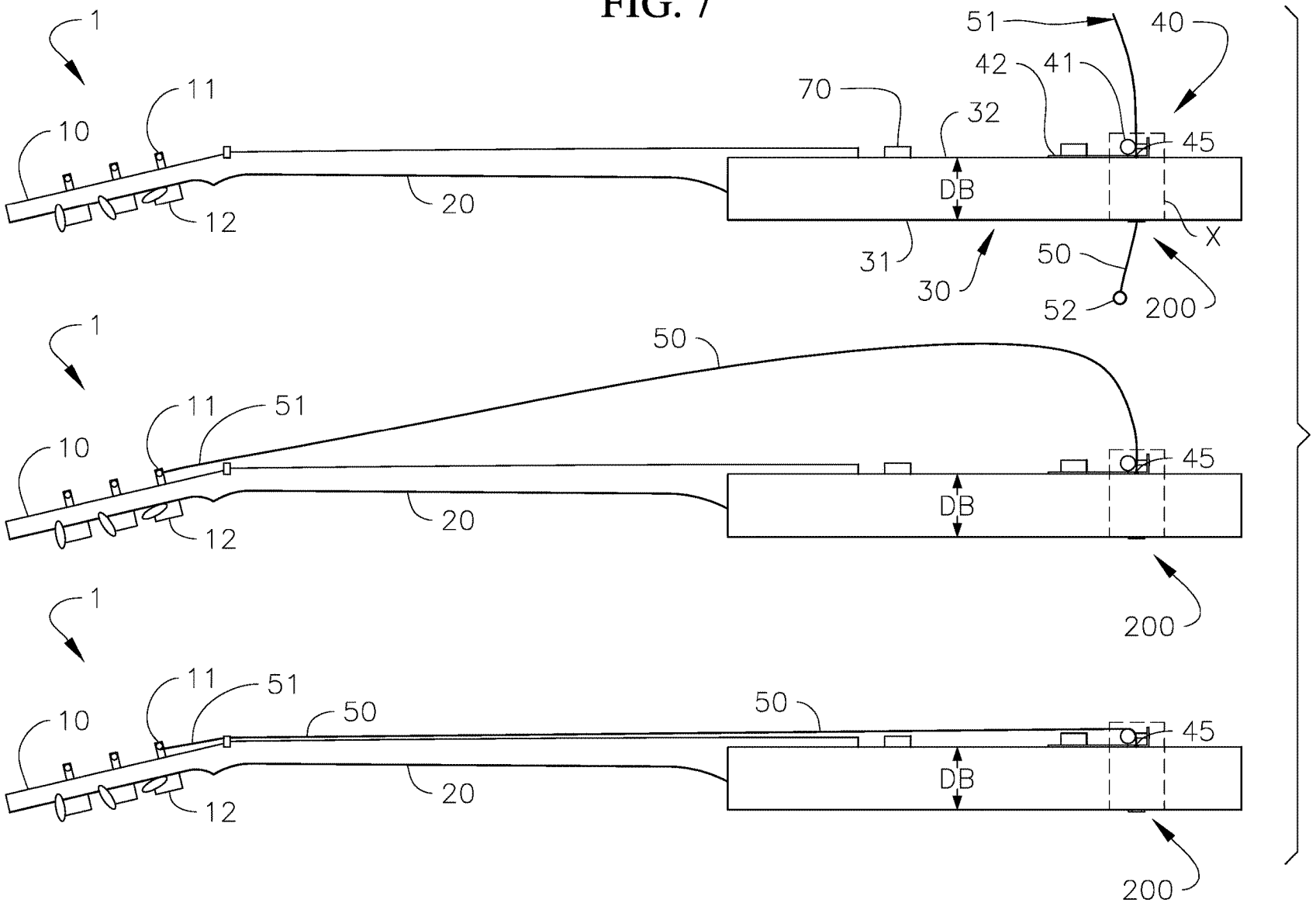
FIG. 7 illustrates a method of securing a musical instrument string to a stringed musical instrument according to an embodiment of the present invention.

Referring to FIG. 6 and FIG. 7, a method for securing the string 50 to the musical instrument 1 using the retainer 200 of the present disclosure is shown. First, the non-ball end 51 of the string 50 may be fed through the first opening 201 of the retainer 200 until it emerges through the bridge string hole 45. Second, the string may be pulled through the bridge string hole 45 until the ball end 52 is seated toward the distal end of the ball-end chamber, and the non-ball end 51 of the string 50 may be secured to the tuning post 11. Third, the string may be tightened with the tuner 12 until the ball end 52 of the string 50 remains seated against the distal end of the ball-end chamber 211 by way of a tension applied to the string 50.

While the present invention has been particularly shown and described with reference to some example embodiments thereof, it will be understood by those of ordinary skill in the art that various changes in form and details may be made therein without departing from the spirit and scope of the present invention as set forth in the following claims and their equivalents.

What is claimed is:

1. A retainer for securing a musical instrument string to a body of a musical instrument, the retainer comprising:

a first casing portion defining a first opening and a ball-end chamber therein, the first opening being located at a proximal end of the retainer; and a second casing portion located at a distal end of the first casing portion, and defining a passageway from the ball-end chamber to a second opening located at a distal end of the retainer, wherein the first casing portion and the second casing portion are configured to be mounted within a body string hole, wherein a passageway length is greater than a ball-end chamber length, and wherein a ball-end chamber width is greater than a passageway width.

2. The retainer of claim 1, wherein a first casing portion width is greater than a second casing portion width.

3. The retainer of claim 1, wherein the first casing portion and the second casing portion are integrally formed.

4. The retainer of claim 1, wherein an overall length of the retainer is between about 1.8 inches and about 2.0 inches.

5. The retainer of claim 1, further comprising an alloy.

6. The retainer of claim 1, further comprising a flange located at a proximal end of the retainer, a flange width being greater than a first casing portion width.

7. The retainer of claim 1, wherein the musical instrument is a guitar or a bass.

8. The retainer of claim 1, wherein the passageway width is about equal to or less than a diameter of a bridge string hole.

9. The retainer of claim 1, wherein the ball-end chamber width is about equal to or greater than a first width and a second width of a ball end of the musical instrument string.

10. The retainer of claim 1, wherein the ball-end chamber length is about equal to or greater than a ball-end height of the musical instrument string.

11. The retainer of claim 1, wherein the passageway width is about equal to or greater than a thickness of the musical instrument string and less than a first width and a second width of a ball end of the musical instrument string.

12. The retainer of claim 1, wherein a retainer depth is about equal to a body depth of the musical instrument.

13. The retainer of claim 1, wherein a first casing portion width is about equal to a bottom portion width of the body string hole.

14. The retainer of claim 1, wherein a second casing portion width is about equal to or greater than a top portion width of the body string hole.

15. A stringed musical instrument comprising:

a head comprising a tuning post;

a neck;

a body comprising a body string hole;

a bridge comprising a bridge string hole; and a retainer, the retainer comprising:

a first casing portion defining a first opening and a ball-end chamber therein, the first opening being located at a proximal end of the retainer; and a second casing portion located at a distal end of the first casing portion and defining a passageway from the ball-end chamber to a second opening located at a distal end of the retainer, wherein the first casing portion and the second casing portion are configured to be mounted within the body string hole, wherein a passageway length is greater than a ball-end chamber length, and wherein a ball-end chamber width is greater than a passageway width.

16. The stringed musical instrument of claim 15, wherein the passageway width is about equal to or less than a diameter of the bridge string hole.

17. The stringed musical instrument of claim 15, wherein a retainer depth is about equal to a body depth of the stringed musical instrument.

18. The stringed musical instrument of claim 15, wherein a width of the second casing portion is about equal to or greater than a top portion width of the body string hole.

19. The stringed musical instrument of claim 15, wherein the stringed musical instrument is a guitar or a bass.

20. A method for securing a musical instrument string to a musical instrument, the method comprising:

securing a non-ball end of the musical instrument string to a tuning post; and securing a ball end of the musical instrument string to a retainer in a body of the musical instrument, the retainer comprising:

a first casing portion defining a first opening and a ball-end chamber therein, the first opening being located at a proximal end of the retainer; and a second casing portion located at a distal end of the first casing portion and defining a passageway from the ball-end chamber to a second opening located at a distal end of the retainer, wherein the first casing portion and the second casing portion are configured to be mounted within a body string hole, wherein a passageway length is greater than a ball-end chamber length, and wherein a ball-end chamber width is greater than a passageway width.

* * * * *